US006506032B2

(12) United States Patent
Kawahara et al.

(10) Patent No.: US 6,506,032 B2
(45) Date of Patent: Jan. 14, 2003

(54) LINEAR COMPRESSOR

(75) Inventors: Sadao Kawahara, Shiga (JP); Teruyuki Akazawa, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/780,354

(22) Filed: Feb. 12, 2001

(65) Prior Publication Data

US 2001/0014292 A1 Aug. 16, 2001

(30) Foreign Application Priority Data

Feb. 14, 2000 (JP) ..... 2000-034676

(51) Int. Cl.[7] ..... F04B 35/04
(52) U.S. Cl. ..... 417/417; 417/338; 92/83
(58) Field of Search ..... 417/338, 343, 417/417; 92/83, 162 R, DIG. 2

(56) References Cited

U.S. PATENT DOCUMENTS

| | | | | | |
|---|---|---|---|---|---|
| 1,996,160 | A | | 4/1935 | Konig | 230/55 |
| 3,329,334 | A | * | 7/1967 | Curwen | 417/338 |
| 3,359,872 | A | * | 12/1967 | Foster | 92/172 |
| 3,368,850 | A | * | 2/1968 | Wilcox | 384/12 |
| 3,543,061 | A | * | 11/1970 | Wallace | 310/17 |
| 3,588,291 | A | | 6/1971 | Curwen et al. | 417/417 |
| 3,986,434 | A | * | 10/1976 | Köhler | 92/172 |
| 4,799,421 | A | | 1/1989 | Bremer et al. | 92/162 R |
| 5,525,845 | A | | 6/1996 | Beale et al. | 310/30 |
| 5,597,294 | A | * | 1/1997 | McGrath | 417/417 |
| 5,772,410 | A | * | 6/1998 | Chang | 417/417 |
| 6,077,054 | A | * | 7/2000 | Lee et al. | 417/417 |
| 6,089,836 | A | * | 7/2000 | Seo | 417/417 |
| 6,231,310 | B1 | * | 5/2001 | Tojo et al. | 417/417 |
| 6,238,192 | B1 | * | 6/2001 | Lee | 417/417 |

FOREIGN PATENT DOCUMENTS

| | | | | |
|---|---|---|---|---|
| EP | 96/03601 | | 2/1996 | |
| GB | 392811 | | 5/1933 | |
| JP | 58030561 A | * | 2/1983 | 92/172 |

* cited by examiner

*Primary Examiner*—Charles G. Freay
*Assistant Examiner*—John F. Belena
(74) *Attorney, Agent, or Firm*—Armstrong, Westerman & Hattori, LLP

(57) ABSTRACT

An object of the present invention is to provide a high-efficiency and reliable linear compressor in which even when a pressing force is applied to its piston, the piston is turnably connected and supported through a connecting rod so that sliding surface pressure between the piston and a cylinder is not increased. The invention provides a linear compressor comprising a cylinder supported in a hermetic vessel by a support mechanism, a piston slidably supported by the cylinder along its axial direction, a spring member for applying an axial force to the piston, a connecting mechanism for connecting the piston and the spring member with each other, and a linear motor having a stator coupled to the cylinder and a moving member coupled to the piston, wherein and the connecting mechanism is connected to the piston such the connecting mechanism can rock with respect to the piston.

6 Claims, 2 Drawing Sheets

LINEAR COMPRESSOR

BACKGROUND OF THE INVENTION (1) Field of the Invention

The present invention relates to a linear compressor for reciprocating a piston fitted in a cylinder by a linear motor to draw in, compress and discharge gas.

(2) Description of the Prior Art

In a refrigeration cycle, HCFC refrigerants such as R22 are stable compounds and decompose the ozone layer. In recent years, HFC refrigerants have begun to be utilized as alternative refrigerants to HCFCs, but these HFC refrigerants have the nature for facilitating global warming. Therefore, a study has been started to employ HC refrigerants which do not decompose the ozone layer or largely affect global warming. However, since HC refrigerant is flammable, it is necessary to prevent explosion or ignition so as to ensure safety. For this purpose, it is required to reduce the amount of HC refrigerant to be used to small a quantity as possible. When a general refrigerant is used in the refrigeration cycle, although oil is used as a lubricant, the refrigerant itself also has lubricity. On the other hand, the HC refrigerant itself does not have lubricity and is easily melted into a lubricant.

For these reasons, when the HC refrigerant is used, an oilless or oil pure compressor is required. A linear compressor in which a load applied in a direction perpendicular to an axis of its piston is small and a sliding surface pressure is small is known as a compressor which can be easily realize oilless compression as compared with a reciprocal type compressor, a rotary compressor and a scroll compressor. In the case of the linear compressor the sliding degree of the sliding surfaces between the cylinder and the piston affects the efficiency and durability of the linear compressor. Therefore, considerable complicated means is required for constituting an oilless linear compressor.

SUMMARY OF THE INVENTION

In view of the above circumstances, it is an object of the present invention to provide a high-efficiency and reliable linear compressor in which even when a pressing force is applied to its piston, the piston is turnably connected and supported through a connecting rod so that sliding surface pressure between the piston and a cylinder is not increased.

It is another object of the invention to provide a linear compressor capable of enhancing a bearing effect by forming a fluid bearing between its cylinder and piston.

According to a first aspect of the present invention, there is provided a linear compressor comprising a cylinder supported in a hermetic vessel by a support mechanism, a piston slidably supported by the cylinder along its axial direction, a spring member for applying an axial force to the piston, a connecting mechanism for connecting the piston and the spring member with each other, and a linear motor having a stator coupled to the cylinder and a moving member coupled to the piston, wherein the connecting mechanism is connected to the piston such that the connecting mechanism can rock with respect to the piston.

With the first aspect, even if a force trying to incline the piston, e.g., a pressing force caused by a pressing force from a spring member or a magnetic attraction force generated in the linear motor is applied to the piston when the piston is operated, the outer peripheral surface of the piston follows an inner peripheral surface of the cylinder, the sliding surface pressure is reduced, a mechanical loss is reduced, and the efficiency and reliability of the linear compressor are enhanced.

According to a second aspect of the invention, in the linear compressor of the first aspect, the connecting mechanism comprises a connecting rod having one end connected to the piston and the other end connected to the spring member, the one end of the connecting rod is formed into a spherical end, the piston is provided at its axially center portion with a ball seat for holding the spherical end.

With the second aspect, the force applied to the piston is moderated, and the efficiency and reliability of the linear compressor are enhanced.

According to a third aspect of the invention, in the linear compressor of the second aspect, the ball seat is formed in the vicinity of a center of gravity of the piston.

With the third aspect, rotation moment is not applied to the piston, the sliding surface pressure is reduced, and the efficiency and reliability of the linear compressor are enhanced.

According to a fourth aspect of the invention, there is provided a linear compressor comprising a cylinder supported in a hermetic vessel by a support mechanism, a piston slidably supported by the cylinder along its axial direction, a spring member for applying an axial force to the piston, and a linear motor having a coupling portion coupled to the cylinder and a moving member coupled to the piston, wherein a fluid bearing is formed between the piston and the cylinder.

With the fourth aspect, pressure acting on the sliding surface is reduced, the mechanical loss is largely reduced, and the efficiency and reliability of the linear compressor are enhanced.

According to a fifth aspect of the invention, in the linear compressor of the fourth aspect, the fluid bearing comprises a dynamic pressure groove formed in an outer peripheral surface of the piston.

With the fifth aspect, the piston can be held by the dynamic pressure generated in the dynamic pressure groove. As a result, the sliding surface pressure can be reduced, and the efficiency and reliability of the linear compressor are enhanced.

According to a sixth aspect of the invention, in the linear compressor of the fourth aspect, the fluid bearing comprises an introducing path for introducing a discharged gas into the cylinder, and a through hole formed in the cylinder, and the through hole brings the introducing path and a sliding surface of the cylinder.

With the sixth aspect, the pressure between the cylinder and the sliding surface of the piston is largely reduced and as a result, the efficiency and reliability of the linear compressor are enhanced.

DESCRIPTION OF THE PREFERRED EMBODIMENTS

Figure 1:
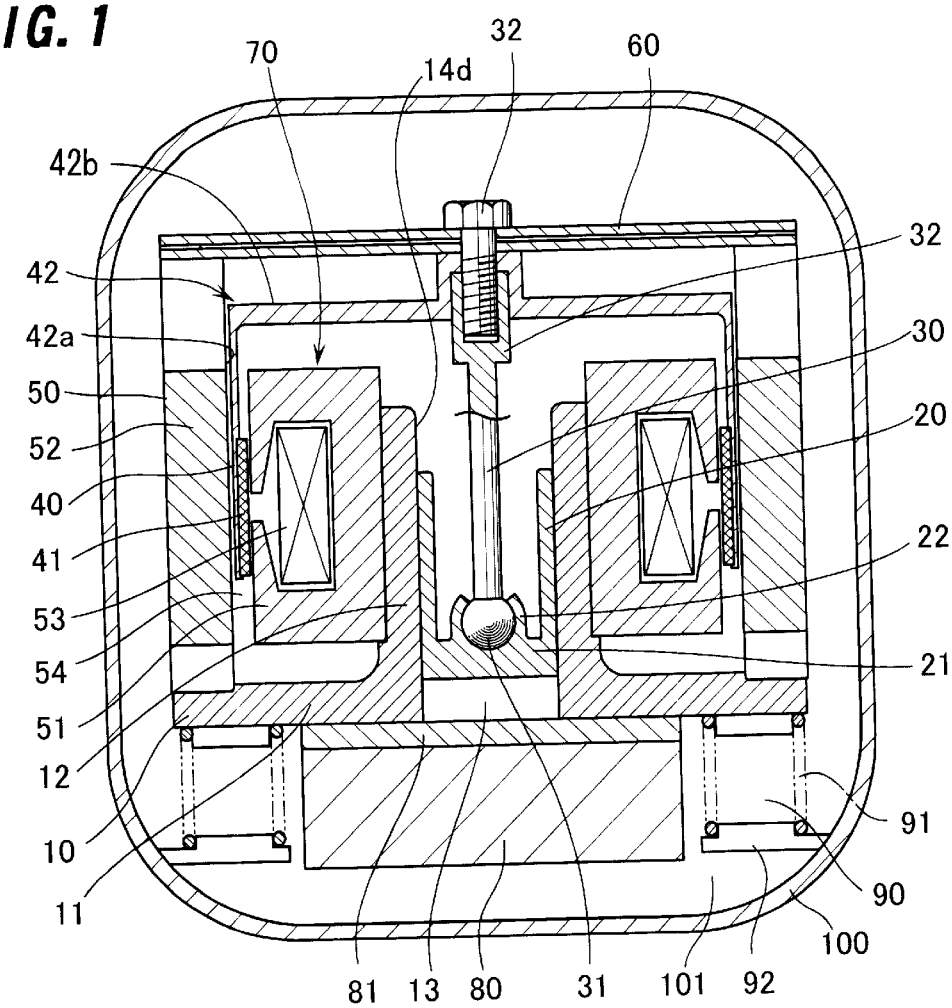
FIG. 1 is a sectional view showing an entire structure of a linear compressor of an embodiment of the present invention.

First, an entire structure of a linear compressor of the present embodiment will be explained with reference to FIG. 1. This linear compressor comprises a cylinder 10 supported by a support mechanism 90 in a hermetic vessel 100, a piston 20 slidably supported by the cylinder 10 along an axial direction thereof, a spring member 60 for applying an axial force to the piston 20, a linear motor 70 having a stator 50 connected to the cylinder 10 and a moving member 40 supported in a reciprocating path formed in the stator 50 such that the moving member 40 can reciprocate, a connecting rod 30 which is one of connecting mechanisms connected to the piston 20, and a head cover 80 having a suction valve, a discharge valve and the like for charging and discharging solvent to and from a compression chamber 13 of the cylinder 10. One end of the connecting rod 30 is connected to the spring member 60, and the moving member 40 is also connected to the spring member 60.

The hermetic vessel 100 comprises a container for accommodating essential constituent elements of the linear compressor. A refrigerant is supplied to space 101 in the hermetic vessel 100 from a suction tube (not shown), and the refrigerant is introduced toward an intake side of the head cover 80. A compressed refrigerant is discharged out from a discharge tube (not shown) connected to the hermetic vessel 100 through the head cover 80.

The support mechanism 90 comprises a spring-support plate 92 fixed to an interior of the hermetic vessel 100, and a plurality of coil springs 91 mounted on the spring-support plate 92 for supporting the cylinder 10. The coil springs 91 function to prevent vibration from being transmitted from the cylinder 10 to the hermetic vessel 100.

The cylinder 10 comprises a flange 11 against which the coil springs 91 abut, and a boss 12 projecting from a center of this flange 11 toward one end (upward in FIG. 1) of the cylinder 10. The flange 11 and the boss 12 are integrally formed. A sliding face 14*d* against which the piston 20 abuts is formed on an inner peripheral surface of the boss 12.

The piston 20 comprises a cylindrical body having an outer peripheral surface 24 (FIG. 2) slidably supported by the sliding face 14*d* of the cylinder 10. An inner surface of the cylinder 10 is formed with a recess, and a center of gravity of the inner surface is located at a bottom 21. A ball seat 22 having a spherical recess is formed in an axial center of the bottom 21. As shown in the drawing, a compression chamber 13 is formed between a head of the piston 20 and the head cover 80 closely connected to the flange 11 of the cylinder 10.

As shown in FIG. 1, the spring member 60 comprises a disc-like member in this embodiment. When a peripheral edge of the spring member 60 is fixed, a portion of the spring member 60 from its peripheral edge to the center thereof is resiliently deformed.

The linear motor 70 comprises the moving member 40 and the stator 50. The stator 50 comprises an inner yoke 51 and an outer yoke 52. The inner yoke 51 comprises a cylindrical body and is fixed to the boss 12 in a circumscribing manner. A coil 53 is accommodated in the inner yoke 51 and connected to a power source (not shown). The outer yoke 52 comprises a cylindrical body covering the inner yoke 51, and is fixed to the flange 11 of the cylinder 10. A reciprocating path 54 having small space is formed between an inner peripheral surface of the outer yoke 52 and an outer peripheral surface of the inner yoke 51. In the present embodiment, a peripheral edge of the spring member 60 is supported on and fixed to the outer yoke 52.

The moving member 40 of the linear motor 70 comprises a permanent magnet 41, and a cylindrical holding member 42 for holding the permanent magnet 41. The cylindrical holding member 42 is accommodated in the reciprocating path 54 such that the holding member 42 can reciprocate therein. The cylindrical holding member 42 comprises a peripheral edge 42*a* for fixing the permanent magnet 41 and a disc 42*b* integrally connected to the peripheral edge 42*a*. A center portion of the disc 42*b* is fixed to a center portion of the spring member 60. The permanent magnet 41 is disposed at a position opposed to the coil 53, and a constant fine gap is formed therebetween. The inner yoke 51 and the outer yoke 52 are disposed coaxially so as to uniformly keep the fine gap over the entire circumferential region.

The connecting rod 30 of the connecting mechanism comprises a slender rod, and is formed at its one end (lower end in the FIG. 1) with a spherical end 31. The other end of the connecting rod 30 is connected to the center portion of the disc 42*b* of the cylindrical holding member 42, and fixed to the center portion of the spring member 60. In this embodiment, the other end of the connecting rod 30 is detachably connected to the center of the disc 42*b*. The spherical end 31 comprises a ball rotatably fitted in the ball seat 22 of the piston 20.

The head cover 80 is fixed to an end surface of the flange 11 of the cylinder 10 through a valve plate 81. A suction valve (not shown) that can be brought into communication with the compression chamber 13, a discharge valve (not shown) and the like are assembled into the valve plate 81. The suction valve and the discharge valve are respectively connected to intake-side space (not shown) and discharge-side space (not shown) provided in the head cover 80. A suction tube and a discharge tube are respectively connected to the intake-side space and the discharge-side space.

Next, operation of the linear compressor of the above structure will be explained. First, if the coil 53 of the stator 50 is energized, thrust, which is proportional to the current, is generated between the moving member 40 and the permanent magnet 41 in accordance with Fleming's left-hand rule. A driving force is applied to the moving member 40 for moving the moving member 40 in its axial direction by this generated thrust. Since the cylindrical holding member 42 of the moving member 40 is connected to the spring member 60 together with the connecting rod 30, the piston 20 moves. Since the piston 20 is rotatably connected coupled to the piston 20 through the ball seat 22 provided in the piston 20 and the spherical end 31 of the connecting rod 30, the piston 20 smoothly moves in the axial direction. The coil 53 is energized with sine wave, thrust in normal direction and thrust in the reverse direction are alternately generated in the linear motor. By the alternately generated thrust in the normal and thrust in the reverse direction, the piston 20 reciprocates.

The refrigerant is introduced from the suction tube into the hermetic vessel 100. The refrigerant introduced into the hermetic vessel 100 enters the compression chamber 13 from the intake-side space of the head cover 80 through the suction valve assembled into the valve plate 81. The refrigerant is compressed by the piston 20 and discharged out from the discharge tube (not shown) through the discharge valve assembled into the valve plate 81 and the discharge-side space of the head cover 80. Vibration of the cylinder 10 caused by a reciprocating motion is restrained by the coil springs 91.

As explained above, since the piston 20 rotatably connected to the connecting rod 30 through the ball seat 22 provided in the piston 20 and the spherical end 31 of the connecting rod 30, the connecting rod 30 can rock with respect to the piston 20. Therefore, even if a force trying to incline the piston 20 even slightly, e.g., a pressing force of the spring member 60 or a magnetic attraction force generated in the linear motor 70 is applied to the connecting rod 30, the outer peripheral surface of the piston 20 follows the inner peripheral surface of the cylinder 10, and the sliding surface pressure is not increased. This can enhance the efficiency and reliability of the compressor. Since the ball seat 22 is provided in the vicinity of the center of gravity of the piston 20, rotation moment of the piston 20 itself is not applied, and the sliding surface pressure can be reduced further. Since the moving member 40 of the linear motor is fixed to and supported by the spring member 60, the spring member 60 can receive the magnetic attraction force generated between the moving member 40 and the stator 50, a force applied to the piston 20 is reduced, and the sliding loss can also be reduced.

Figure 2:
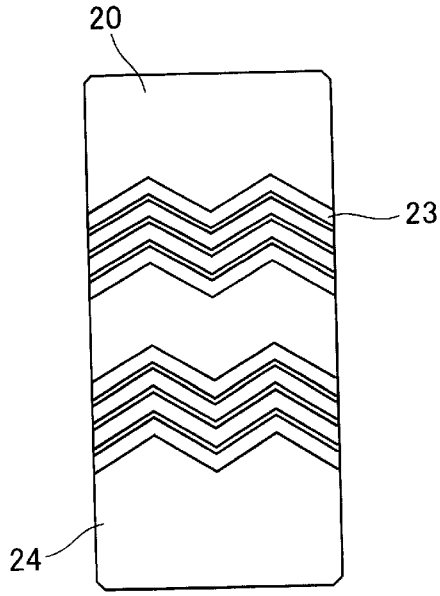
FIG. 2 is a plan view of a piston surface showing an embodiment of a fluid bearing of the invention.

Next, a dynamic pressure groove, which is one of embodiments of a fluid bearing, will be explained with reference to FIG. 2. This dynamic pressure groove 23 comprises bent (angle) herringbone grooves arranged in a plurality of rows formed in an outer peripheral surface 24 of the piston 20. The piston 20 is held by a dynamic pressure generated in the dynamic pressure groove 23 as the piston 20 reciprocates, thereby minimizing the sliding contact between the inner peripheral surface of the cylinder 10 and the outer peripheral surface of the piston 20. With this dynamic pressure groove 23, the efficiency and the reliability of the compressor can further be enhanced.

Figure 3A:
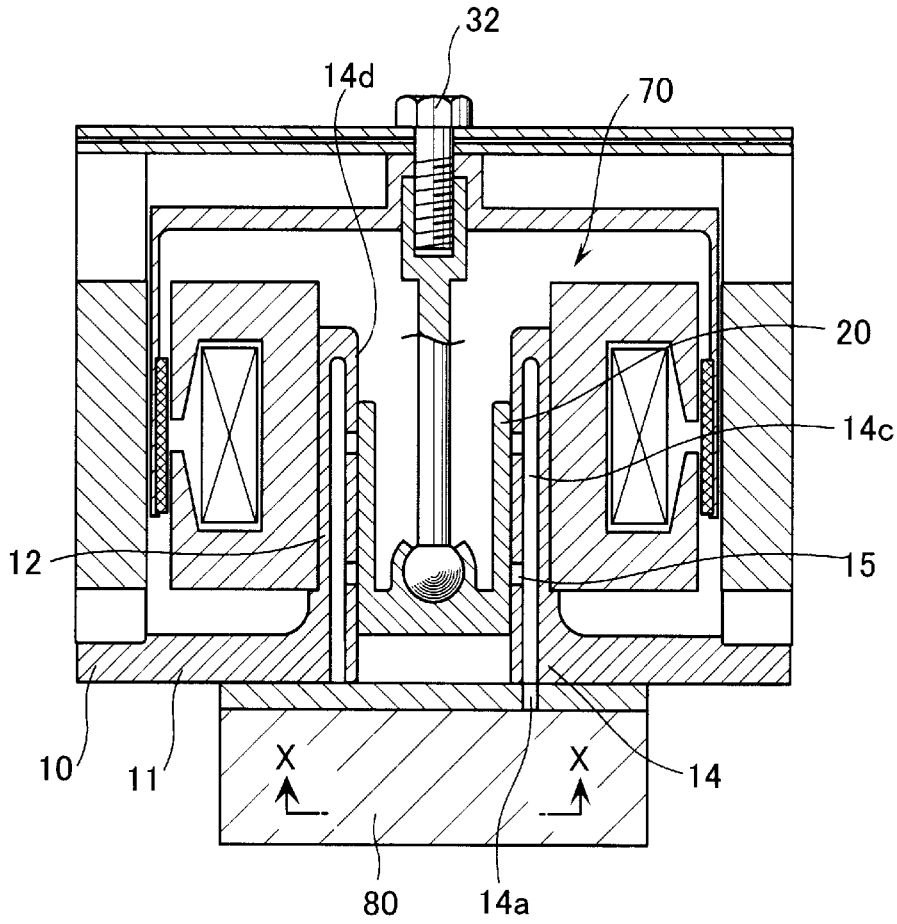
FIG. 3A is an enlarged sectional view of an essential portion of a linear compressor according to another embodiment of the fluid bearing of the invention.
Figure 3B:
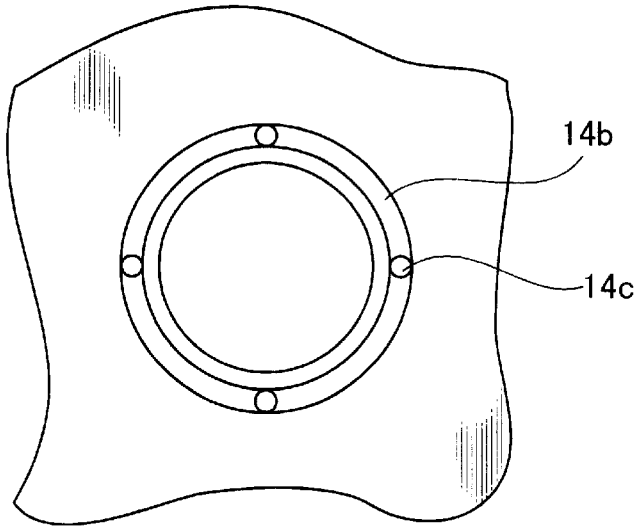
FIG. 3B is a plane view taken along the arrow X in FIG. 3A.

FIGS. 3A and 3B show another embodiment of the fluid bearing. This bearing is a gas bearing utilizing a high-pressure refrigerant gas. This gas bearing includes introducing paths 14 and through holes 15. The introducing path 14 includes a ring groove 14*b* formed in an end surface of the flange 11 of the cylinder 10, a plurality of introducing holes 14*c* formed in the boss 12 of the cylinder 10, and communication holes 14*a* which are in communication with the ring groove 14*b* from the discharge-side space of the head cover 80. Each of the through holes 15 comprises a plurality of holes which bring the introducing holes 14*c* and the sliding face 14*d* of the cylinder 10 into communication with each other. With this structure, the high-pressure refrigerant gas from the introducing path 14 is injected from the plurality of through holes 15 to hold the piston 20. As a result, it is possible to minimize the sliding contact between the inner peripheral surface of the cylinder 10 and the outer peripheral surface of the piston 20. With this bearing, the efficiency and the reliability of the compressor can further be enhanced.

What is claimed is:

1. A linear compressor comprising a cylinder supported in a hermetic vessel by a support mechanism, a piston slidably supported by said cylinder along the cylinders axial direction, a spring member for applying an axial force to said piston, a connecting mechanism for connecting said piston and said spring member with each other such that said connecting mechanism can rock with respect to said piston, and a linear motor having a stator coupled to said cylinder and a moving member coupled to said piston.

2. A linear compressor according to claim 1, wherein said connecting mechanism comprises a connecting rod having one end connected to said piston and the other end connected to said spring member, said one end of said connecting rod is formed into a spherical end, said piston is provided at its axially center portion with a ball seat for holding said spherical end.

3. A linear compressor according to claim 2, wherein said ball seat is formed in the vicinity of a center of gravity of said piston.

4. A linear compressor according to claim 1, wherein a fluid bearing is formed between said piston and said cylinder.

5. A linear compressor according to claim 4, wherein said fluid bearing comprises a dynamic pressure groove formed in an outer peripheral surface of said piston.

6. A linear compressor according to claim 4, wherein said fluid bearing comprises an introducing path for introducing a discharged gas into said cylinder, and a through hole formed in said cylinder, and said through hole brings said introducing path and a sliding surface of said cylinder into communication with each other.

* * * * *